US005897448A

United States Patent [19]

Chang

[11] Patent Number: 5,897,448

[45] Date of Patent: Apr. 27, 1999

[54] ADJUSTABLE HANDLE WITH AIR HOLE AND CONTROL VALVE

[76] Inventor: Hu Hun Chang, P.O. Box:63-150, Taichung, Taiwan

[21] Appl. No.: 09/060,029

[22] Filed: Apr. 15, 1998

[51] Int. Cl.[6] ..... A63B 49/08

[52] U.S. Cl. ..... 473/552; 473/296; 473/568; 81/177.2; 81/489

[58] Field of Search ..... 473/549, 552, 473/551, 296, 298, 558, 559, 564, 568; 81/489, 177.2

[56] References Cited

U.S. PATENT DOCUMENTS

| | | | |
|---|---|---|---|
| 3,931,968 | 1/1976 | Hedberg | 473/552 |
| 4,641,838 | 2/1987 | Gabrielidis | 473/552 |
| 5,029,860 | 7/1991 | Ehrich | 473/296 |
| 5,193,419 | 3/1993 | Lee | 81/177.2 |
| 5,355,552 | 10/1994 | Huang | 473/549 X |
| 5,524,879 | 6/1996 | Lyle | 473/552 |
| 5,609,336 | 3/1997 | Tashjian | 473/560 |

*Primary Examiner*—Raleigh W. Chiu

[57] ABSTRACT

An adjustable apparatus handle having a shaft, a grip sleeved onto the shaft, and a butt cap fixedly fastened to one end of the grip, wherein the shaft has a front part of polygonal cross section, a rear part of reduced diameter, and a piston endpiece at one end of the rear part remote from the front part; the grip has a front part fitting over the front part of the shaft, a rear part fitting over the rear part of the shaft and defining an air chamber between the piston endpiece of the shaft and the butt cap; the butt cap having an air hole disposed in communication between the air chamber and the atmosphere, and a control valve moved in the air hole between a first position where the air hole is closed and the air chamber is maintained in an air tight status to stop the shaft from an axial movement in the grip, and a second position where the air hole is opened and air is allowed to pass between the air chamber and the atmosphere, permitting the shaft to be moved axially in the grip.

4 Claims, 4 Drawing Sheets

ADJUSTABLE HANDLE WITH AIR HOLE AND CONTROL VALVE

BACKGROUND OF THE INVENTION

The present invention relates to a handle for a sports apparatus, and more particularly to an adjustable apparatus handle that can be conveniently adjusted to change its length.

A racket for tennis game or badminton game or a club for golf game commonly has a handle made to be held by the hand. The handle of an apparatus for a sports game has a fixed length. In order to fit different requirements, sports apparatus suppliers commonly provide different sizes for every item. For example, the size of a tennis racket ranges from 27" to 31". However, the limited range in size cannot fit all requirements. Further, it is not economic to prepare several pieces of apparatus of different sizes for every item.

SUMMARY OF THE INVENTION

The present invention has been accomplished under the circumstances in view. It is one object of the present invention to provide an apparatus handle which can be conveniently adjusted to change its length subject to individual requirement. It is another object of the present invention to provide an apparatus handle which is suitable for use in any of a variety of apparatus for different sports games.

According to one aspect of the present invention, the adjustable apparatus handle comprises a shaft, a grip sleeved onto the shaft, and a butt cap fixedly fastened to one end of the grip, wherein the shaft has a front part of polygonal cross section, a rear part of reduced diameter, and a piston endpiece at one end of the rear part remote from the front part; the grip has a front part fitting over the front part of the shaft, a rear part fitting over the rear part of the shaft and defining an air chamber between the piston endpiece of the shaft and the butt cap; the butt cap having an air hole disposed in communication between the air chamber and the atmosphere, and a control valve moved in the air hole between a first position where the air hole is closed and the air chamber is maintained in an air tight status to stop the shaft from an axial movement in the grip, and a second position where the air hole is opened and air is allowed to pass between the air chamber and the atmosphere, permitting the shaft to be moved axially in the grip.

According to another aspect of the present invention, the control valve has one end integral with a control plate for pressing by hand to move the control valve from the first position to the second position, and a spring is provided inside the butt cap which imparts an outward pressure to the control plate, causing the control valve to moved from the second position to the first position.

DETAILED DESCRIPTION OF THE PREFERRED EMBODIMENT

Figure 1:
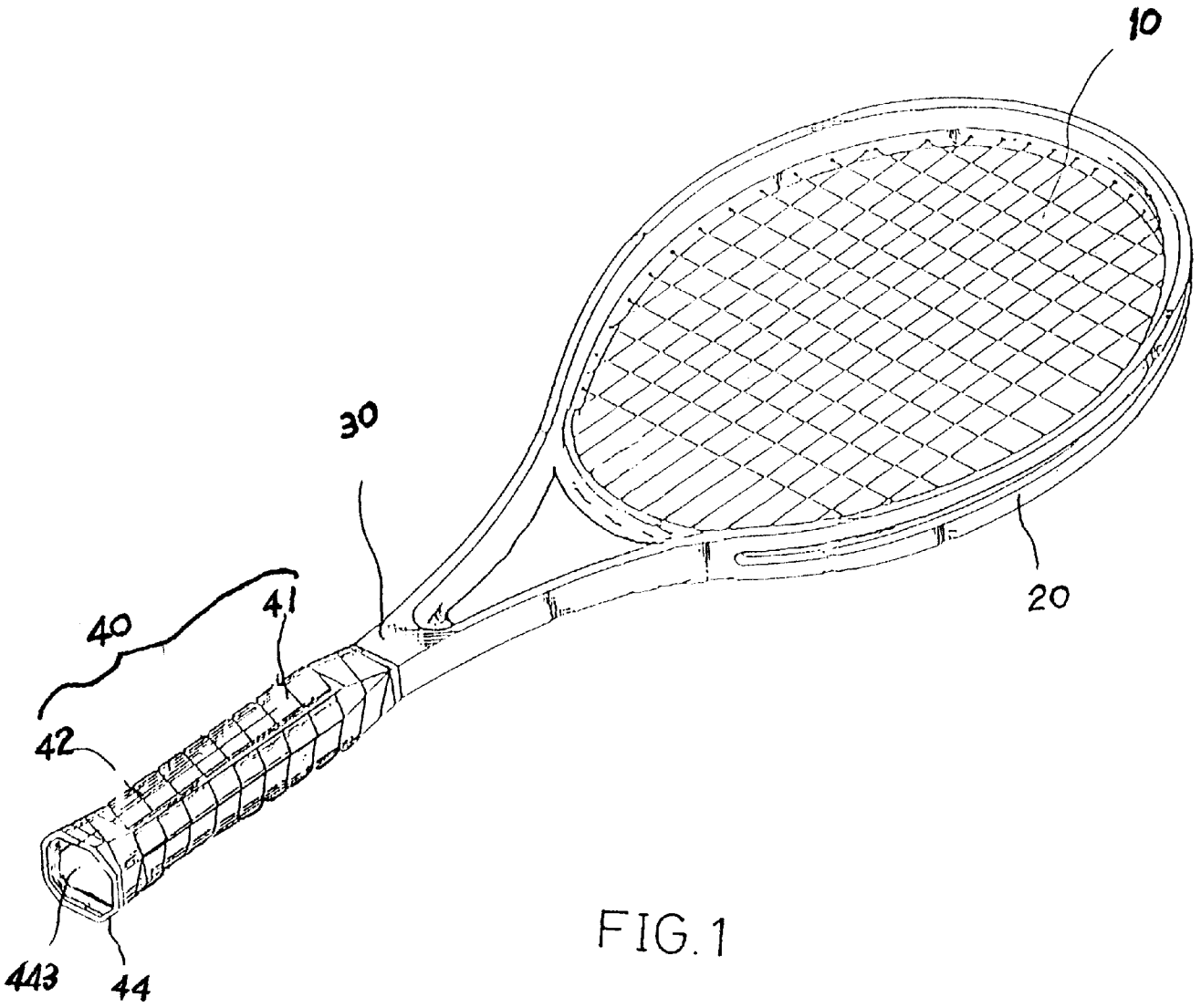
FIG. 1 is a perspective view of a racket equipped with an adjustable handle constructed according to the present invention.
Figure 2:
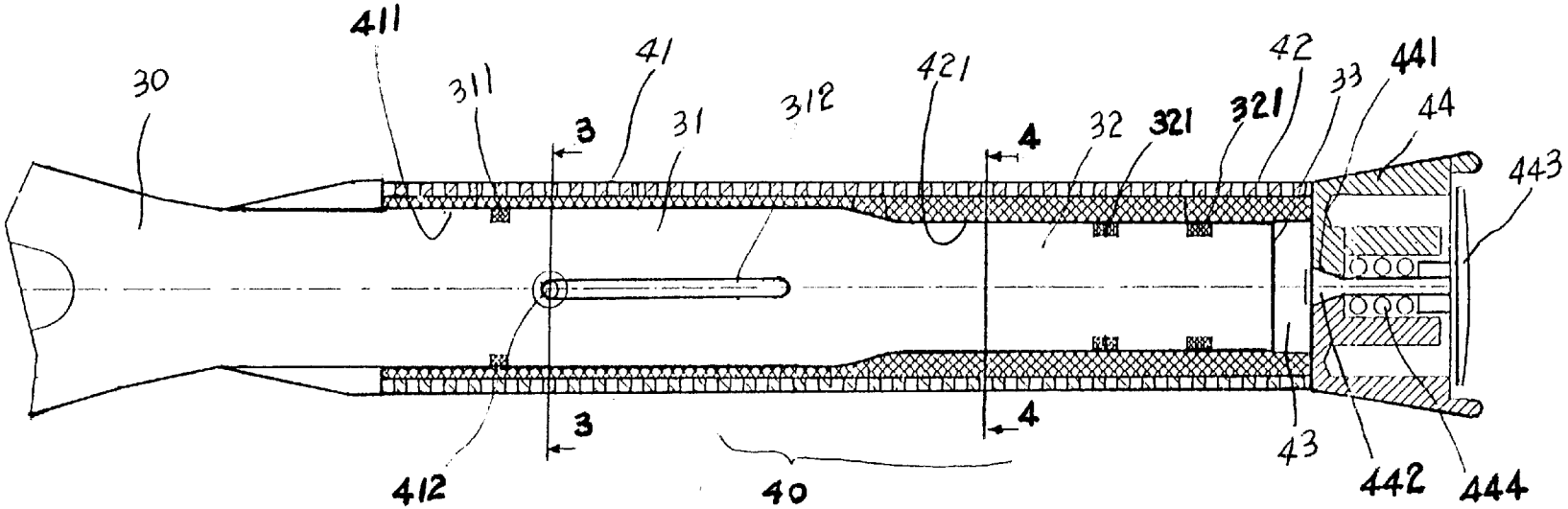
FIG. 2 is a sectional view in an enlarged scale of the adjustable handle shown in FIG. 1.

Referring to FIGS. 1 and 2, a tennis racket is shown having a head frame 20, a striking surface 10 stretched within the head frame 20, a shaft 30 axially extended from the head frame 20, and a grip 40 at the end of the shaft 30.

Figure 4:
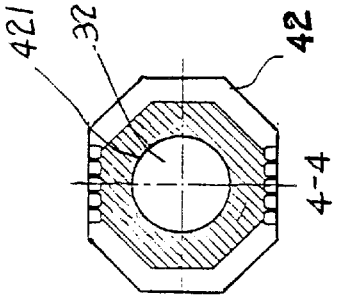
FIG. 4 is a sectional view taken along line 4—4 of FIG. 2.
Figure 3:
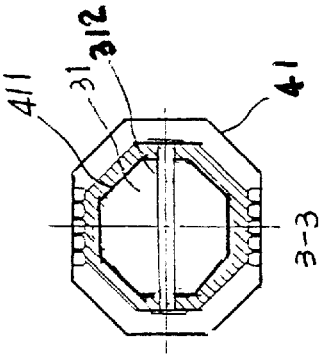
FIG. 3 is a sectional view taken along line 3—3 of FIG. 2.

Referring to FIGS. 3 and 4 and FIG. 2 again, the shaft 30 has a predetermined length. The front part 31 of the shaft 30 has a polygonal for example octagonal cross section as shown in FIG. 3. The rear part 32 of the shaft 30, as shown in FIG. 4, is a rounded rod of relatively smaller outer diameter, having a piston endpiece 33. One rubber ring 311 is fixedly mounted around the front part 31 of the shaft 30 remote from the rear part 32. A longitudinal sliding slot 312 is provided at the front part 31 of the shaft 30 on the middle. The longitudinal sliding slot 312 transversely pierced through the front part 31 of the shaft 30. Two rubber rings 321 are fixedly mounted around the rear part 32 of the shaft 30.

The grip 40 is a sleeve member sleeved onto the shaft 30. The front part 41 of the grip 40 defines an axially extended octagonal hole 411 which receives the front part 31 of the shaft 30, as shown in FIG. 3, and prohibits the shaft 30 from a rotary motion relative to the grip 40. The rear part 42 of the grip 40 defines an axially extended circular hole 421 which receives the rear part 32 of the shaft 30. The length of the circular hole 421 is longer than the length of the rear part 32 of the shaft 30, so that the piston endpiece 33 and the rear part 42 of the grip 40 defines a receiving space 43 at one end of the circular hole 421. A butt cap 44 is fixedly mounted on the rear part 42 of the grip 40 to close the circular hole 421. Therefore, the receiving space 43 forms an air chamber. The butt cap 44 has a tapered air hole 441 axially disposed at the center in communication with the receiving space 43. A tapered control valve 442 is mounted in the tapered air hole 441. A control plate 443 is connected to one end of the tapered control valve 442. A spring 444 is mounted inside the butt cap 44 around the control valve 442. The spring 444 imparts an outward pressure to the control plate 443, causing the tapered control valve 442 to close the tapered air hole 441. When the tapered air hole 441 is sealed by the control valve 442, the receiving space 43 is maintained in an air tight status, thus the shaft 30 is prohibited from an axial movement relative to the grip 40.

Figure 5:
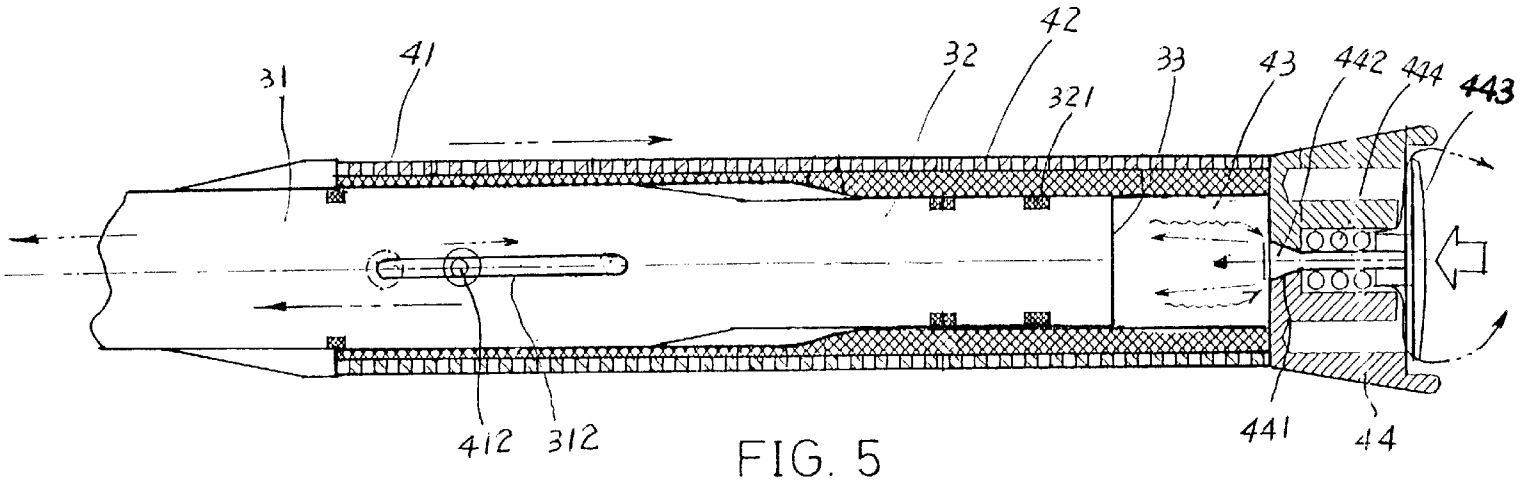
FIG. 5 is a sectional view of the present invention, showing the control plate depressed, the tapered control valve opened from the tapered air hole, the shaft moved axially in the grip.
Figure 6:
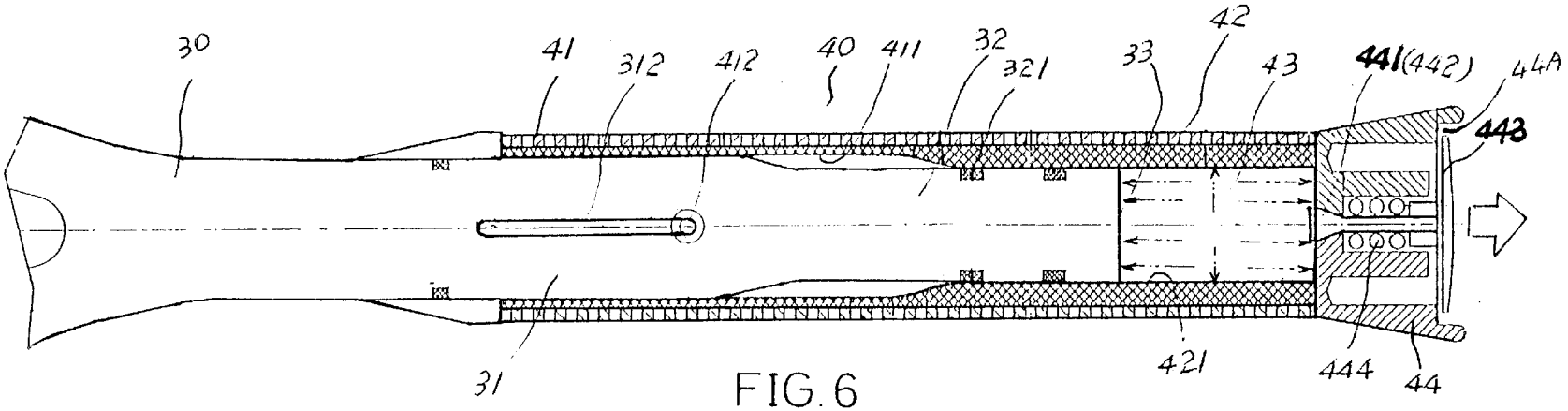
FIG. 6 is another sectional view of the present invention showing the position of the shaft adjusted.

Referring to FIGS. 5 and 6, when the control plate 443 is squeezed inwards with the hand, the spring 444 is compressed, and the tapered control valve 442 is moved forwards to open the tapered air hole 441 for permitting air to pass in and out of the receiving space 43, and therefore the shaft 30 is allowed to be moved axially in the grip 40 (see FIG. 5). After the shaft 30 has been moved axially in the grip 40 to the desired position, the hand is released from the control plate 443. After the control plate 443 has been released from the hand, the spring 444 immediately pushes the control plate 443 back to its former position, thereby causing the tapered control valve 442 to close the tapered air hole 441 again, and therefore the shaft 30 is stopped in place by air pressure in the receiving space 43 (see FIG. 6). In order to prevent the grip 40 from escaping out of the shaft

30, a locating pin 412 is inserted through the longitudinal sliding slot 312 with its both ends fixedly fastened to the front part 41 of the grip 40 at two opposite sides (see also FIG. 3).

Referring to Figures from 1 to 6 again, the axially extended octagonal hole 411 of the front part 41 of the grip 40 fits octagonal cross section of the front part 31 of the shaft 30, therefore the shaft 30 is prohibited from a rotary motion relative to the grip 40, and can only be moved axially in the grip 40. As indicated above, the axially extended circular hole 421 of the rear part 42 of the grip 40 fits the circular cross section of the rear part 32 of the shaft 30, rubber rings 311;321 are respectively mounted around the front part 31 and rear part 32 of the shaft 30 and held down by the inside wall of the grip 40, and the tapered air hole 441 is closed by the tapered control valve 442, therefore the receiving space 43 is normally maintained in an air tight status to stop the shaft 30 from an axial movement in the grip 40. When the control plate 443 is depressed to open the tapered control valve 442 from the tapered air hole 441, the shaft 30 is allowed to be moved axially in the grip 40 to adjust the length of the handle (the shaft 30 and the grip 40 form a handle).

Figure 7:
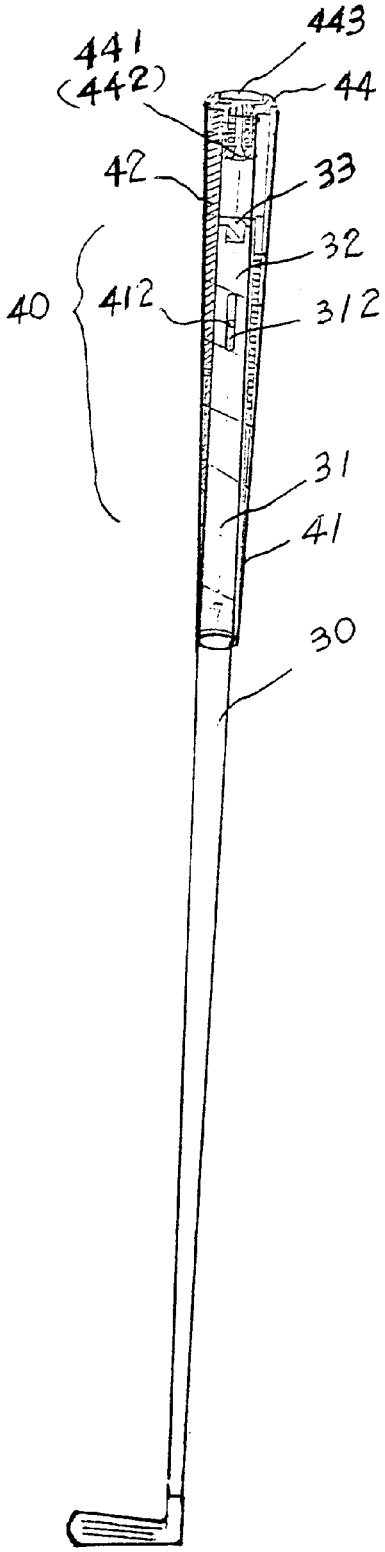
FIG. 7 is a sectional view of another application example of the present invention.

Further, the aforesaid design can be used in any of a variety of sports apparatus. FIG. 7 shows the invention used in a golf club.

It is to be understood that the drawings are designed for purposes of illustration only, and are not intended as a definition of the limits and scope of the invention disclosed.

What the invention claimed is:

1. An adjustable apparatus handle comprising a shaft, a grip sleeved onto said shaft, and a butt cap fixedly fastened to one end of said grip, wherein said shaft has a front part of polygonal cross section, a rear part of reduced diameter, and a piston endpiece at one end of the rear part of said shaft remote from the front p art of said shaft; said grip has a front part fitting over the front part of said shaft, a rear part fitting over the rear part of said shaft and defining an air chamber between the piston endpiece of said shaft and said butt cap; said butt cap comprises an air hole disposed in communication between said air chamber and the atmosphere, and a control valve moved in said air hole between a first position where said air hole is closed and said air chamber is maintained in an air tight status to stop said shaft from an axial movement in said grip, and a second position where said air hole is opened and air is allowed to pass between said air chamber and the atmosphere, permitting said shaft to be moved axially in said grip.

2. The adjustable apparatus handle of claim 1, wherein the front part of said shaft has a longitudinal slot; the front part of said grip is fixedly mounted with a locating pin, said locating pin being inserted through said longitudinal slot on said shaft to limit the axial moving distance of said shaft in said grip.

3. The adjustable apparatus handle of claim 1, wherein the rear part of said shaft has a circular cross section, and is mounted with a plurality of rubber rings retained peripherally in close contact with said grip.

4. The adjustable apparatus of claim 1, wherein said air hole on said butt cap is a tapered hole; said control valve has one end extended out of said air hole and fixedly mounted with a control plate for pressing by hand; spring means is mounted inside said butt cap, said spring means imparting an outward pressure to said control plate, causing said control valve to be moved to said first position to close said air hole.

* * * * *